US006032315A

United States Patent [19]

Liebel

[11] Patent Number: 6,032,315

[45] Date of Patent: Mar. 7, 2000

[54] DEVICE FOR CLEANING A HUMAN TONGUE

[76] Inventor: Gary M. Liebel, 1302 Old Meadow Rd., Pittsburgh, Pa. 15241

[21] Appl. No.: 09/104,118

[22] Filed: Jun. 24, 1998

Related U.S. Application Data

[60] Provisional application No. 60/050,638, Jun. 24, 1997, and provisional application No. 60/066,283, Nov. 14, 1997.

[51] Int. Cl.[7] ..... A46B 5/00

[52] U.S. Cl. ..... 15/160; 15/111

[58] Field of Search ..... 15/111, 160, 167.1; D4/104, 134

[56] References Cited

U.S. PATENT DOCUMENTS

| | | | |
|---|---|---|---|
| D. 243,422 | 2/1977 | Varga . | |
| D. 309,528 | 7/1990 | Valenti . | |
| D. 332,352 | 1/1993 | Caldwell et al. . | |
| D. 354,624 | 1/1995 | Gupta . | |
| D. 367,707 | 3/1996 | Baker | D4/104 |
| 1,647,453 | 11/1927 | Krantz | 15/167.1 |
| 3,254,356 | 6/1966 | Yao et al. . | |
| 3,943,592 | 3/1976 | Bhaskar et al. | 15/160 |
| 4,079,478 | 3/1978 | Andrews, Sr. . | |
| 4,455,704 | 6/1984 | Williams . | |
| 4,638,521 | 1/1987 | Potente | 15/167.1 |
| 5,226,197 | 7/1993 | Nack et al. | 15/111 |
| 5,511,273 | 4/1996 | Carroll . | |
| 5,613,262 | 3/1997 | Choy-Maldonado | 15/160 |
| 5,735,864 | 4/1998 | Heisinger | 15/111 |
| 5,749,116 | 5/1998 | Wieder et al. | 15/160 |
| 5,778,477 | 7/1998 | Conway | 15/167.1 |

*Primary Examiner*—Terrence R. Till
*Attorney, Agent, or Firm*—Webb Ziesenheim Logdon Orkin & Hanson, P.C.

[57] ABSTRACT

A device for cleaning a tongue in the form of an elongated member including a head portion having a generally rectangular shape in plan view. A plurality of bristles extend from a lower surface of the head portion wherein a total of a length of the bristles plus a thickness of said head portion is less than about ½ inch. An elongated, arcuate handle portion extends from the head portion and is aligned such that a longitudinal axis of the handle portion is transverse with a longitudinal axis of the head portion. The device may also include a lip downwardly depending from the front of the head portion to retain accumulated debris as the device is pulled along the tongue.

12 Claims, 1 Drawing Sheet

DEVICE FOR CLEANING A HUMAN TONGUE

CROSS REFERENCE TO RELATED APPLICATIONS

This application claims priority of my previously filed U.S. Provisional Application Ser. No. 60/050,638, filed Jun. 24, 1997 and U.S. Provisional Application Ser. No. 60/066,283, filed Nov. 14, 1997, the disclosures of which are incorporated by reference herein.

BACKGROUND OF THE INVENTION

My invention relates generally to the treatment and prevention of bad breath and, more particularly, to a device for cleaning odor causing debris from the human tongue. Various devices have been proposed heretofore in the form of tongue brushes, tongue scrapers, or combined toothbrushes and tongue cleaners, as exemplified by U.S. Pat. Nos. 4,455,704; 4,079,478; and 3,254,356. None of these devices have, to my knowledge, gained any widespread usage, perhaps due to their complexity of manufacture and/or ineffective operation.

My invention solves the problems encountered in prior tongue cleaning appliances by providing a tongue cleaning device which is both convenient to use and effective in results, while being economical to manufacture.

SUMMARY OF THE INVENTION

Briefly stated my invention is directed to a device for cleaning the human tongue comprising a member having an elongated handle portion and a rectangular head portion arranged transversely to the longitudinal axis of the handle portion. The head portion carries a plurality of bristles thereon, wherein the total thickness of the head portion and bristles is less than about ½ inch. The bristles may be nylon having a length of about ⅛ inch and clustered in groups or tufts. The bristles may also be integrally molded with the head portion or integrally molded with a carrier plate which is, in turn, attached to the head portion. The handle portion is actually formed to define an angle of about 10°–20° between the plane of the head portion and the longitudinal axis of the handle to better position the head portion relative to the tongue surface and to follow the convexity of the tongue at the rear of the mouth approaching the throat.

The device also preferably carries a downwardly protruding lip along a leading edge of the head portion to act as a collector for debris dislodged by the bristles. The lip extends downwardly from the head portion a distance of about ⅛ inch, i.e., the same length as the bristles so as not to interfere with their cleaning action. The device permits the user to reach the back surface of the tongue due to its arcuate configuration and permits cleaning of the back surface without causing a gagging reflex due to its thin profile. Cleaning of the back surface of the tongue is especially important in eliminating halitosis or "bad breath".

These as well as other attributes and advantages of my invention will become better understood when reference is made to the appended drawings, taken with the following detailed description.

DETAILED DESCRIPTION OF THE INVENTION

Figure 1:
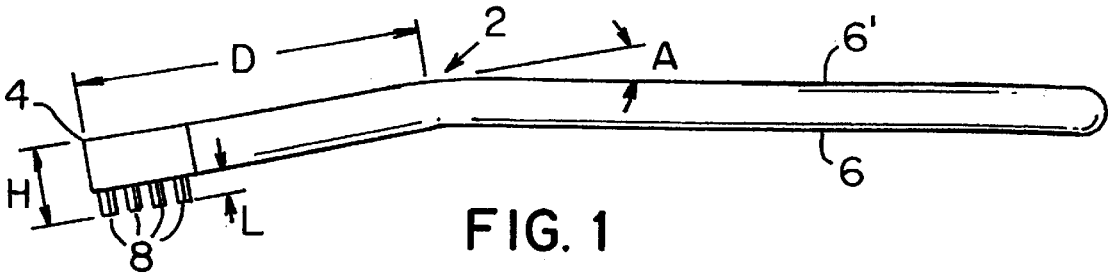
FIG. 1 is a longitudinal side view of a presently preferred embodiment of the tongue cleaning device of the present invention.

Reference will now be made to the drawings wherein identical elements are referred to by the same reference numerals throughout the various views and like elements are referred to by primed numerals.

Figure 2:
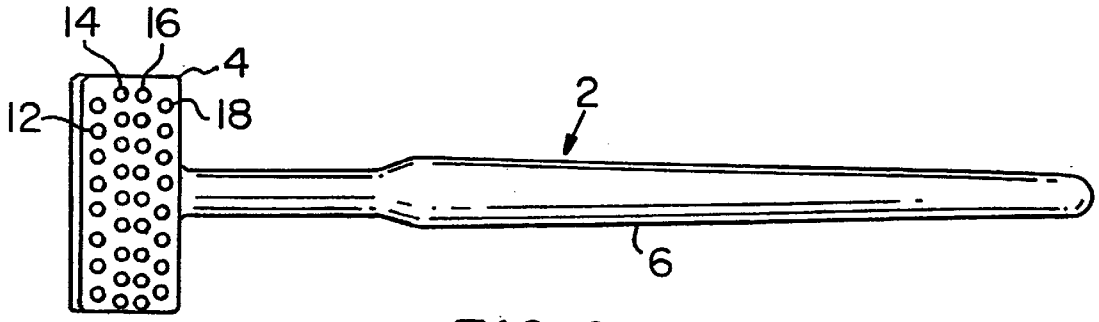
FIG. 2 is a bottom plan view of the device of FIG. 1.

The tongue cleaning device of the invention, generally designated 2, is in the form of an elongated member and includes a head portion 4 and a handle portion 6. The head portion 4 includes a plurality of bristle tufts 8. Each bristle tuft 8 is made up of a plurality of individual bristles. By way of example, the bristles are made of nylon and are 0.006–0.007 in diameter. Each tuft 8 consists of about 24–36 strands of bristles measuring about ⅛ inch in diameter per tuft. The ends of the bristle tufts are flat and preferably lie in a common plane, extending outwards from a bottom face of the head portion a distance "L". Hence "L" is the bristle length, which is preferably about ⅛ inch. As can be seen in FIG. 2, the tufts 8 in the rows 12 and 14 and in rows 16 and 18 are offset from one another so as to insure proper cleaning as the head portion 4 is moved in a direction coincident with the longitudinal axis of the handle 6. The distance between adjacent tufts 8 is about 0.045 inch to avoid open spaces along the cleaning axis.

The overall height dimension "H" comprising the thickness of the head portion 4 and the bristle length "L" is no greater than about ½ inch and, more preferably, no greater than about ⅜ inch. It is desirable to maintain a thin profile represented by dimension "H" so as to minimize or eliminate any possible gagging reflex when the head portion 4 is moved to the back of the tongue.

Figure 3:
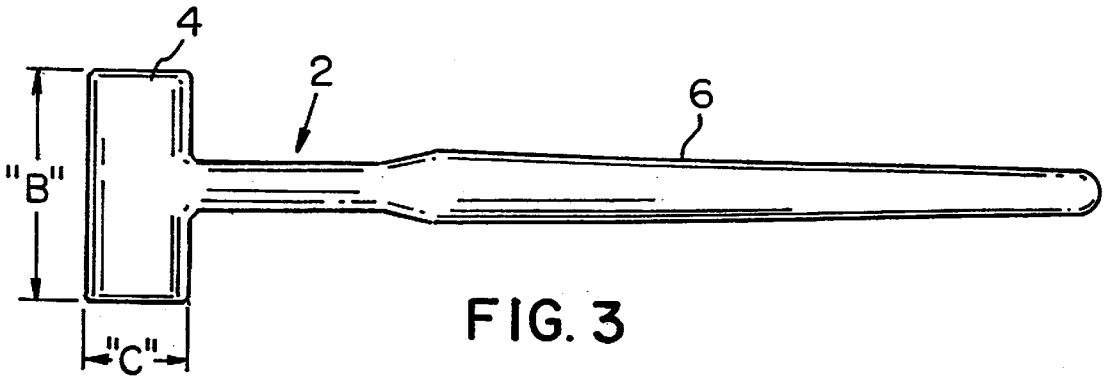
FIG. 3 is a top plan view of the device of FIG. 1.
Figure 4:
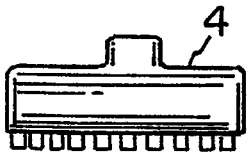
FIG. 4 is a front elevation view of the device of FIG. 1.

The head portion 4 is rectangular in plan view and arranged such that the longitudinal axis of the head portion 4 is substantially perpendicular with the longitudinal axis of the handle portion 6. In this manner, the longer side (dimension "B" in FIG. 3) of the head portion engages a substantial transverse dimension across the tongue surface. Dimension "B" defines the length of the head portion 4 and is preferably about 1¼ inches to about 1½ inches. The width of the head portion identified as dimension "C" in FIG. 3 is about ½ inch, which is sufficient to accommodate the placement of four rows of bristle tufts 12, 14, 16 and 18 shown in FIG. 2. A presently preferred embodiment of my invention comprises two outer rows of bristle tufts 12 and 18 containing eleven bristle tufts each and two inner rows of bristle tufts 14 and 16 containing twelve bristle tufts each. This arrangement provides a sufficient number of rows (four) to assure proper loosening of foreign material from the tongue. In addition, the staggered or offset alignment between the bristle tufts in rows 12 and 14 and between those in rows 16 and 18 insures uniform bristle coverage along the length of the head portion 4 as the device 2 is moved by the user in a direction coincident with the longitudinal axis of the handle 6. The device 2 is inserted into the mouth and the bristles 8 are placed against the back surface of the tongue and then pulled forward and then rinsed with water after each pass to remove collected debris. This procedure is repeated, preferably five to eight times, to insure complete tongue cleaning.

Figure 5:
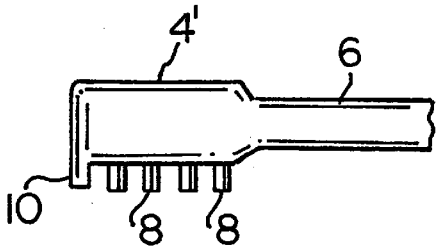
FIG. 5 is a further preferred configuration of the head portion of the tongue cleaning device of the invention.

The head portion 4' shown in FIG. 5 also preferably carries a lip 10 downwardly depending from a front edge thereof. The lip 10 extends across the full length of the head portion (dimension "B") and acts as a collector of loosened debris not collected by the bristles themselves which accumulates as the device is used. This accumulated material is also rinsed with water away from the lip 10 after each pass along the tongue.

In order to provide improved access to the convex surface of the back of the tongue, the handle portion 6 is formed in an arcuate shape as shown in FIG. 1. A plane parallel to the top surface of the head portion 4 and parallel to the ends of the bristles 8 defines an angle "A" with the longitudinal axis of the rear gripping section 6' of the handle portion 6, FIG. 1. Angle "A" is preferably between 10°–20° to better accomudate the convexity of the back surface of the tongue. The bend point is formed at a dimension "D" from the front of the head portion and may range between 1 to 2 inches. The handle 6 is preferably rigid so as to resist bending as pressure is applied downwardly against the tongue during use.

As stated above, the bristles may be formed in bristle tufts 8 comprising a plurality of individual bristle strands affixed to the head portion in the same manner as is a conventional toothbrush. In addition, the bristles may be injection molded integrally with the head portion 4 and handle portion 6. A further embodiment of the present invention envisions that the bristles are integrally molded with a carrier plate (not shown) which, in turn, is affixed to the head portion. Such integral injection molding of the bristles would, of course, lower the cost of the device 2.

The stiffness or softness of the bristles can be varied by varying the diameter of the individual strands, as well as the number of bristles in each tuft 8. The tongue cleaning device 2 is injection molded from a thermoplastic material such as polypropylene or the like and the bristle strands may be of a conventional nylon material.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limited to the scope of the invention which is to be given the full breadth of the appended claims and any and all equivalents thereof.

I claim:

1. A device for cleaning a tongue comprising:

an elongated member including a head portion having a generally rectangular shape in plan view;

a plurality of bristles extending from a lower surface of the head portion wherein a total of a length of said bristles plus a thickness of said head portion is less than about ½ inch; and an elongated handle portion extending from the head portion and aligned such that a longitudinal axis of the handle portion is transverse with a longitudinal axis of the head portion.

2. The tongue cleaning device of claim 1 wherein the handle portion is arcuate in shape.

3. The tongue cleaning device of claim 2 wherein the handle portion defines an angle of between about 10°–20° with a plane defined by a top surface of the head portion.

4. The tongue cleaning device of claim 1 wherein the bristles have a uniform length of about ⅛ inch.

5. The tongue cleaning device of claim 4 wherein the bristles terminate in end portions laying in a common plane.

6. The tongue cleaning device of claim 1 wherein the bristles are arranged in a plurality of bristle tufts wherein each tuft is made up of a plurality of bristle strands affixed to the head portion.

7. The tongue cleaning device of claim 6 wherein the bristle tufts are spaced apart and arranged in rows on the head portion and wherein the bristle tufts in a pair of inner rows of bristle tufts are offset with the bristle tufts in a pair of outer rows of bristle tufts.

8. The tongue cleaning device of claim 1 wherein the bristles are injection molded.

9. The tongue cleaning device of claim 1 including a lip means downwardly depending from a front edge of the head portion for retaining accumulated debris.

10. A device for cleaning a tongue comprising:

an elongated member including a head portion having a generally rectangular shape in plan view;

a plurality of bristles extending from a lower surface of the head portion wherein a total thickness of the head portion and a length of said bristles is less than about ½ inch; and an elongated handle portion extending from the head portion and aligned such that a longitudinal axis of the said handle portion is transverse to a longitudinal axis of the head portion, said handle portion further having an arcuate shape wherein the longitudinal axis of a gripping segment of the handle portion defines an angle of between about 10°–20° with a plane passing along a top surface of the head portion.

11. The tongue cleaning device of claim 10 wherein the bristles have distal ends terminating in a common plane spaced from the lower surface of the head portion about ⅛ inch.

12. A device for cleaning a tongue comprising:

an elongated member including a head portion having a generally rectangular shape in plan view;

a plurality of bristles extending from a lower surface of the head portion wherein a total thickness of the head portion and a length of said bristles is less than about ½ inch;

an elongated handle portion extending from the head portion and aligned such that a longitudinal axis of the said handle portion is transverse to a longitudinal axis of the head portion, said handle portion further having an arcuate shape wherein the longitudinal axis of a gripping segment of the handle portion defines an angle of between about 10°–20° with a plane passing along a top surface of the head portion; and a lip downwardly depending from a front edge of the head portion a distance approximating the length of the bristles for retaining accumulated debris.

* * * * *

UNITED STATES PATENT AND TRADEMARK OFFICE

CERTIFICATE OF CORRECTION

PATENT NO. : 6,032,315

DATED : March 7, 2000

INVENTOR(S) : Gary M. Liebel

It is certified that error appears in the above-identified patent and that said Letters Patent is hereby corrected as shown below:

Column 1 Lines 7-8 "60/066," and "283" should read --60/066,283--.

Column 3 Lines 13-14 "accomudate" should read --accommodate--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*